US008031149B2

(12) United States Patent
Baba et al.

(10) Patent No.: US 8,031,149 B2
(45) **Date of Patent: *Oct. 4, 2011**

(54) IMAGE PROCESSING APPARATUS FOR PROCESSING MOVING IMAGE TO BE DISPLAYED ON LIQUID CRYSTAL DISPLAY DEVICE, IMAGE TO PROCESSING METHOD AND COMPUTER PROGRAM PRODUCT

(75) Inventors: Masahiro Baba, Kanagawa (JP); Goh Itoh, Tokyo (JP); Haruhiko Okumura, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 737 days.

This patent is subject to a terminal disclaimer.

(21) Appl. No.: 12/213,917

(22) Filed: Jun. 26, 2008

(65) Prior Publication Data

US 2009/0109155 A1 Apr. 30, 2009

Related U.S. Application Data

(63) Continuation of application No. 11/371,978, filed on Mar. 10, 2006, now Pat. No. 7,405,717.

(30) Foreign Application Priority Data

Aug. 16, 2005 (JP) ..... 2005-236012

(51) Int. Cl.
*G09G 3/36* (2006.01)

(52) U.S. Cl. ..... 345/89; 345/690

(58) Field of Classification Search ..... 345/88, 345/89, 98–100, 690, 204
See application file for complete search history.

(56) References Cited

U.S. PATENT DOCUMENTS 6,501,451 B1 12/2002 Sakashita
6,853,384 B2 2/2005 Miyata et al.
7,027,016 B2 4/2006 Sakashita
(Continued)

FOREIGN PATENT DOCUMENTS

JP 5-153530 6/1993
(Continued)

OTHER PUBLICATIONS

Decision of a Patent Grant issued by the Japanese Patent Office on Mar. 2, 2010, for Japanese Patent Application No. 2005-236012, and English-language translation thereof.

(Continued)

*Primary Examiner* — Ricardo L Osorio
(74) *Attorney, Agent, or Firm* — Finnegan, Henderson, Farabow, Garrett & Dunner, L.L.P.

(57) ABSTRACT

An image processing method for a liquid crystal display device includes: calculating first difference gradation, which is a difference between predicted attainment gradation and input gradation, the predicted attainment gradation being a predicted value of gradation which respective pixels of the liquid crystal display attain after one frame period after the respective pixels are driven to display a first frame, and the predicted attainment gradation being stored in a storage unit which stores the predicted attainment gradation, and the input gradation being gradation of a second frame which is displayed after the first frame; multiplying the first difference gradation by an enhancement coefficient; calculating enhanced gradation which is a sum of the first difference gradation multiplied by the enhancement, coefficient and the predicted attainment gradation; calculating second difference gradation which is a difference between the enhanced gradation and the predicted attainment gradation; multiplying the second difference gradation by a correction coefficient; and updating the value of the predicted attainment gradation stored in the storage unit based on a sum of the second difference gradation multiplied by the correction coefficient and the predicted attainment gradation.

4 Claims, 7 Drawing Sheets

U.S. PATENT DOCUMENTS

| | | | |
|---|---|---|---|
| 7,148,868 | B2 | 12/2006 | Lee |
| 7,277,076 | B2 | 10/2007 | Shiomi et al. |
| 7,312,777 | B2 | 12/2007 | Miyata et al. |
| 7,427,976 | B2 | 9/2008 | Sugino |
| 2002/0047821 | A1 | 4/2002 | Miyake |
| 2003/0174110 | A1 | 9/2003 | Baba et al. |
| 2004/0125064 | A1 | 7/2004 | Adachi et al. |

FOREIGN PATENT DOCUMENTS

| | | | |
|---|---|---|---|
| JP | 7-20828 | | 1/1995 |
| JP | 2002-62850 | | 2/2002 |
| JP | 2003-264846 | | 9/2003 |
| JP | 2004-246312 | | 9/2004 |
| JP | 2004-341357 | | 12/2004 |
| JP | 2005-17484 | | 1/2005 |
| JP | 2005-107531 | | 4/2005 |
| WO | WO 03/098588 | A1 | 11/2003 |

OTHER PUBLICATIONS

Baba et al., "Apparatus and Method for Processing Moving Picutre, and Computer Program Product," U.S. Appl. No. 11/211,721, filed Aug. 26, 2005.

IMAGE PROCESSING APPARATUS FOR PROCESSING MOVING IMAGE TO BE DISPLAYED ON LIQUID CRYSTAL DISPLAY DEVICE, IMAGE TO PROCESSING METHOD AND COMPUTER PROGRAM PRODUCT

CROSS-REFERENCE TO RELATED APPLICATIONS

This is a continuation of application Ser. No. 11/371,978, filed Mar. 10, 2006 now U.S. Pat. No. 7,405,717, which is incorporated herein by reference.

This application is based upon and claims the benefit of priority from the prior Japanese Patent Application No. 2005-236012, filed on Aug. 16, 2005; the entire contents of which are incorporated herein by reference.

BACKGROUND OF THE INVENTION

1. Field of the Invention

The present invention relates to an image processing apparatus that processes a moving image to be displayed on a liquid crystal display device, an image processing method and an image processing program.

2. Description of the Related Art

In recent years, liquid crystal display devices are used in many fields such as monitors for Personal Computer (PC), notebook PC, and television, and accordingly providing more opportunity to view moving images on liquid crystal display devices. Since, however, the response time of liquid crystal in the liquid crystal display devices is not fast enough, when a moving image is displayed, the deterioration of image quality such as blur and persistence of vision occurs. In general, since the refresh rate of the liquid crystal display devices is 60 Hz, a target response time is 16.7 ms or less in the display of moving images.

In order to improve the response time of the liquid crystal display devices, new liquid crystal materials with short response time are developed, and a method of driving the liquid crystal display devices using conventional liquid crystal materials is improved. As new liquid crystal display materials, smectic type ferroelectric crystal, antiferroelectric crystal and the like are developed, but they have a lot of problems, such as ghosting due to an influence of spontaneous polarization of liquid crystal materials and easy breakage of an orientation state in liquid crystal due to pressure or the like, which have to be solved.

On the other hand, as methods of driving liquid crystal display devices using conventional liquid crystal materials are improved, a method of writing to the liquid crystal display devices a gradation (enhanced gradation) to which predetermined gradation is added according to writing gradation when displayed gradation changes is proposed (for example, see Japanese Patent Application Laid-Open No. 2003-264846: Hereinafter, called as the first document) as a method of improving the response time of the liquid crystal display devices. According to the method in the first document, since the enhanced gradation is obtained by a comparatively simple calculation, a high-speed process can be executed by software.

The method in the first document, however, has a problem that an improving effect of the response time is insufficient between some gradations. For example, in a change from 0 gradation to 255 gradation, since the gradation of image data is generally 255 (8 bit) at the highest, the writing gradation cannot be enhanced. For this reason, the enhanced gradation is also 255, but in this case the response cannot be completed after one frame. In the structure proposed in the first document, when the device needs to obtain enhanced gradation of a next frame, the device calculates the enhanced gradation of the next frame assuming that the current frame has already attained 255, and thus distortion of the response waveform such as undershoot occurs. Such distortion of the response waveform in the liquid crystal display devices is visually recognized as a deterioration of moving images displayed on the liquid crystal display device.

The present invention is devised in order to solve the above problems and its main object is to provide an image processing apparatus, an image processing method, and an image processing program which reduce distortion of a response waveform of a moving image to be displayed on a liquid crystal display device by comparatively simple calculation and is capable of improving image quality.

SUMMARY OF THE INVENTION

According to one aspect of the present invention, an image processing method includes calculating first difference gradation, which is a difference between predicted attainment gradation and input gradation, the predicted attainment gradation being a predicted value of gradation which respective pixels of the liquid crystal display attain after one frame period after the respective pixels are driven to display a first frame, and the predicted attainment gradation being stored in a storage unit which stores the predicted attainment gradation, and the input gradation being gradation of a second frame which is displayed after the first frame; multiplying the first difference gradation by an enhancement coefficient; calculating enhanced gradation which is a sum of the first difference gradation multiplied by the enhancement coefficient and the predicted attainment gradation; calculating second difference gradation which is a difference between the enhanced gradation and the predicted attainment gradation; multiplying the second difference gradation by a correction coefficient; and updating the value of the predicted attainment gradation stored in the storage unit based on a sum of the second difference gradation multiplied by the correction coefficient and the predicted attainment gradation.

According to another aspect of the present invention an image processing apparatus includes a predicted attainment gradation storing unit that stores predicted attainment gradation which is a predicted value of gradation which respective pixels of the liquid crystal display attain after one frame period after the respective pixels are driven to display a first frame; an enhanced gradation calculating unit that calculates first difference gradation, which is a difference between the predicted attainment gradation and input gradation, which is gradation of a second frame which is displayed after the first frame, that multiplies the first difference gradation by the enhancement coefficient, and that calculates enhanced gradation, which is a sum of the first difference gradation multiplied by an enhancement coefficient and the predicted attainment gradation; and a predicted attainment gradation calculating unit that calculates second difference gradation which is a difference between the enhanced gradation and the predicted attainment gradation, multiplies the second difference gradation by a correction coefficient, and updates the value of the predicted attainment gradation stored in the storage unit based on a sum of the second difference gradation multiplied by the correction coefficient and the predicted attainment gradation.

A computer program product according to still another aspect of the present invention causes a computer to perform the method according to the present invention.

DETAILED DESCRIPTION OF THE INVENTION

An image processing apparatus, an image processing method, and an image processing program according to the preferred embodiments of the present invention are explained in detail below with reference to the accompanying drawings.

An image processing apparatus according to a first embodiment calculates predicted attainment gradation which is a predicted value of gradation (attainment gradation) which should be attained when a previous frame is displayed, and calculates enhanced gradation according to the calculated predicted attainment gradation and input gradation supplied as an input of gradation to be displayed next time.

The enhanced gradation is gradation which is enhanced by adding predetermined gradation after a response delay of a liquid crystal display device is taken into consideration in order to attain attainment gradation within time for one frame. Hereinafter, the predicted attainment gradation is called as predicted attainment image data, the input gradation is called as input image data, and the enhanced gradation is called as enhanced image data.

Figure 1:
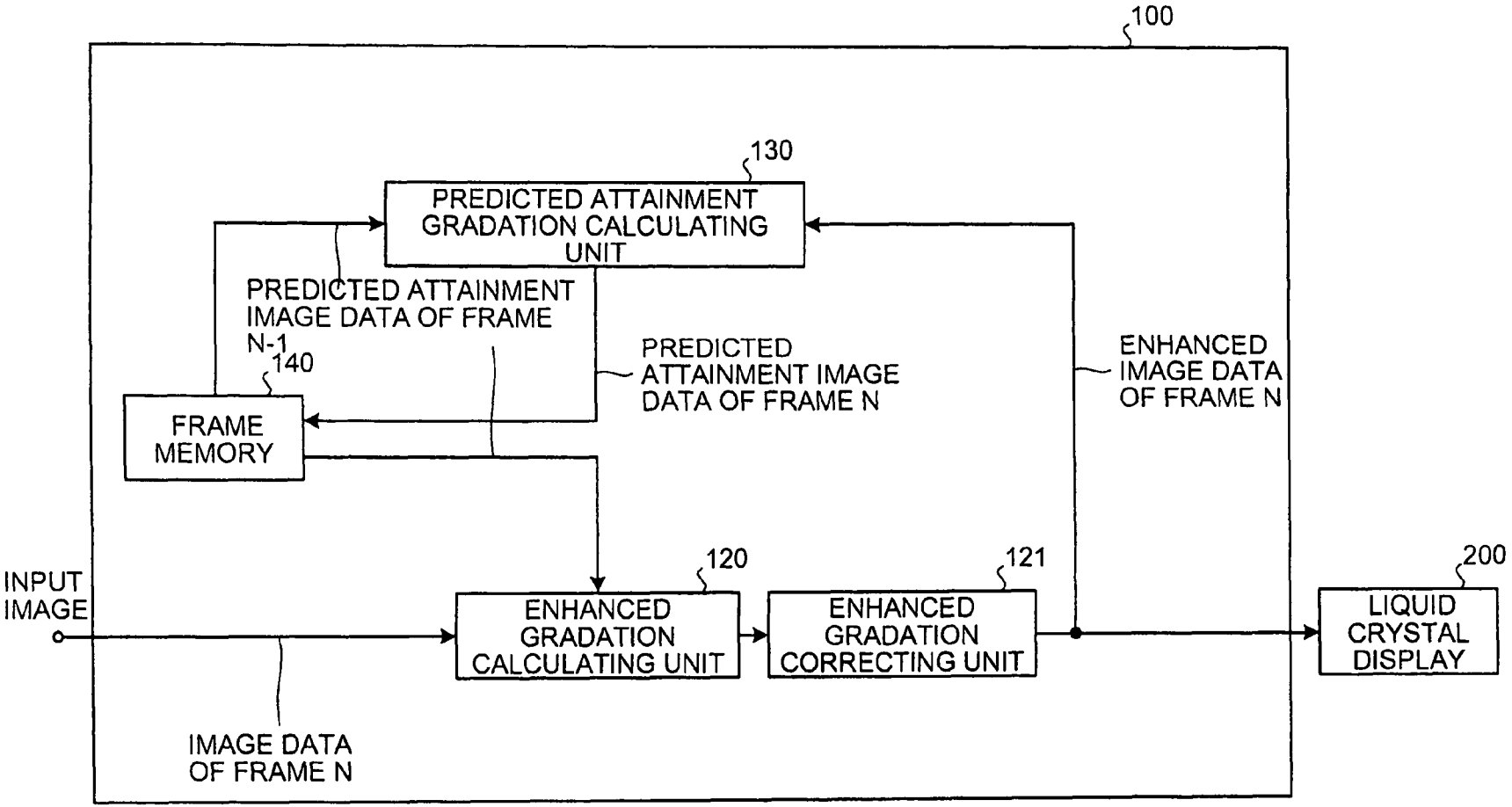
FIG. 1 is a block diagram illustrating a structure of an image processing apparatus according to a first embodiment.

FIG. 1 is a block diagram illustrating a structure of the image processing apparatus 100 according to the first embodiment. As shown in FIG. 1, the image processing apparatus 100 has an enhanced gradation calculating unit 120, an enhanced gradation correcting unit 121, a predicted attainment gradation calculating unit 130, and a frame memory 140.

Firstly, the summary of the image process in the image processing apparatus 100 is explained. Input image data of a frame N (a current frame to be displayed) is input into the enhanced gradation calculating unit 120, and enhanced gradation of gradation of each pixel in a frame is calculated by using predicted attainment image data of a frame N−1 (previous frame) output from the frame memory 140. After the enhanced gradation correcting unit 121 corrects the enhanced gradation, the corrected enhanced gradation is output as enhanced image data of the frame N. The enhanced image data of the frame N is output to a liquid crystal display 200 and displayed on a screen.

The enhanced image data of the frame N is input into the predicted attainment gradation calculating unit 130. The predicted attainment gradation calculating unit 130 calculates and outputs predicted attainment image data of the frame N using the predicted attainment image data of the frame N−1 supplied from the frame memory 140 and the enhanced image data of the frame N. The predicted attainment image data of the frame N is input into the frame memory 140, and the predicted attainment image data of the frame N−1 is updated into the predicted attainment image data of the frame N. In such a manner, the enhanced image data and the predicted attainment image data are calculated repeatedly for each frame.

Functions of components forming the image processing apparatus 100 shown in FIG. 1 are explained below. The frame memory 140 stores the predicted attainment image data calculated by the predicted attainment gradation calculating unit 130.

The enhanced gradation calculating unit 120 calculates enhanced image data (enhanced gradation) of the frame N using the input image data of the frame N and the predicted attainment image data of the frame N−1. Details of the enhanced gradation calculating process are explained later.

The enhanced gradation correcting unit 121 corrects a value of the enhanced image data calculated by the enhanced gradation calculating unit 120 to a value which is within a predetermined range of the liquid crystal display 200. Further, when an absolute value of a difference between the input gradation of the frame N and the predicted attainment gradation of the frame N−1 is less than a threshold value, the enhanced gradation correcting unit 121 may execute a threshold value process for directly outputting the input gradation of the frame N. Details of the enhanced gradation correcting process are explained later.

The predicted attainment gradation calculating unit 130 calculates predicted attainment image data of the frame N using the enhanced image data of the frame N and the predicted attainment image data of the frame N−1, and updates the predicted attainment image data of the frame N−1 stored in the frame memory 140 into the calculated predicted attainment image data of the frame N. Details of the predicted attainment gradation calculating process are explained later.

Details of the enhanced gradation calculating process by the enhanced gradation calculating unit 120, and the enhanced gradation correcting process by the enhanced gradation correcting unit 121 are explained below.

The enhanced gradation calculating unit 120 calculates enhanced image data according to the following formula (1):

$$L_E(N)=\alpha(L_I(N)-L_R(N-1))+L_R(N-1) \quad (1)$$

where $L_I(N)$, $L_R(N)$, and $L_E(N)$ designate gradation of the input image data of the frame N, gradation of the predicted attainment image data, and gradation of the enhanced image data, respectively. The character $\alpha$ represents a value which is specific to the liquid crystal display 200 and is called as enhancement coefficient.

In a first frame of an input image, predicted attainment image data of the previous frame are not stored in the frame memory 140, but in this case enhanced image data may be calculated by using a value ($L_R(0)=0$), i.e., a reset value, zero, of the frame memory 140 previously set or a value of the first frame ($L_R(0)=L_I(N)$).

For example, when the reset value 0 of the frame memory 140 is used, $\alpha L_I(N)$ which is obtained by assigning $L_R(N-1)=0$ to the formula (1), namely, a product of the input image data and the enhancement coefficient is calculated as the enhanced gradation.

Further, when the value of the first frame is used, $L_I(N)$ which is obtained by assigning $L_R(N-1)=L_I(N)$ to the formula (1), namely, the input image data itself is calculated as the enhanced gradation. This is the same as the case in which a still image where a difference is not present between frames is displayed.

Figure 2:
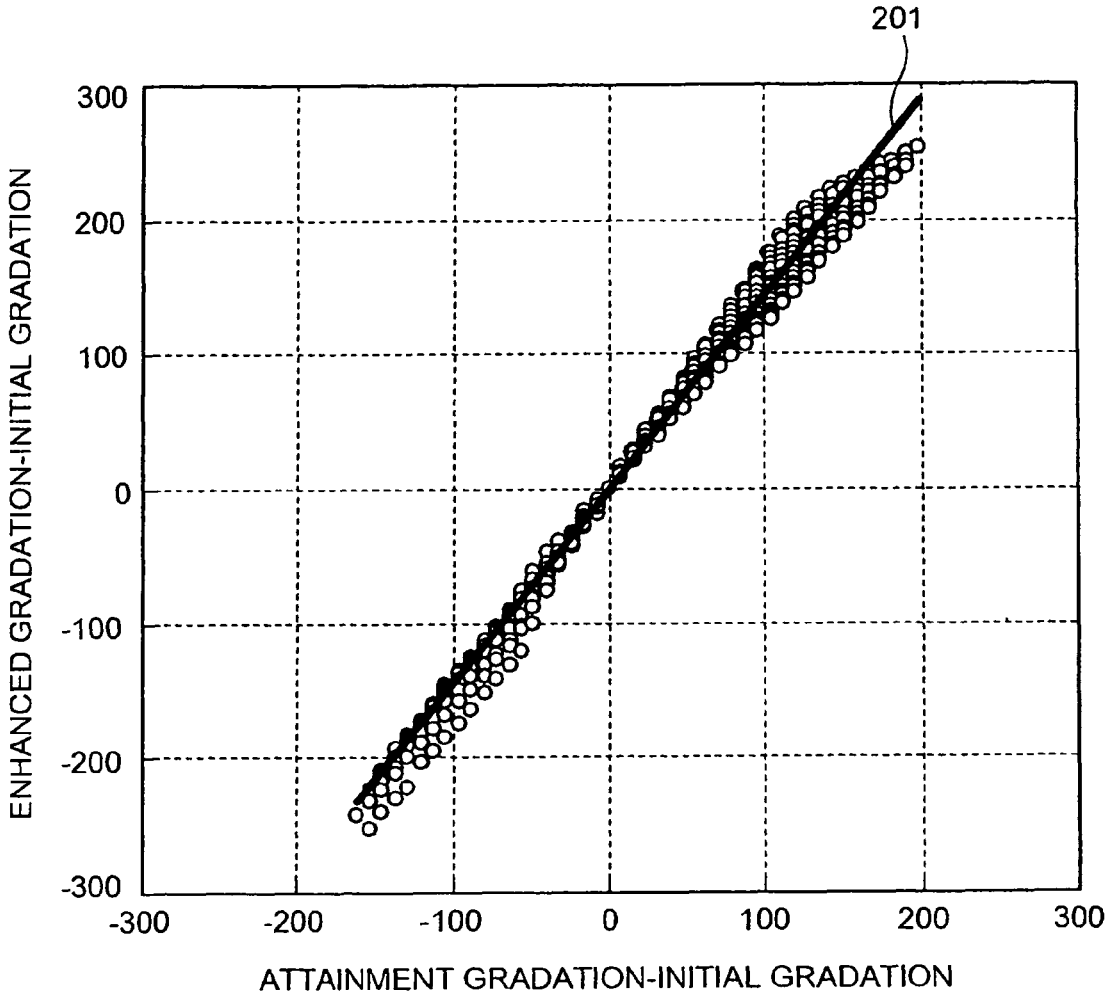
FIG. 2 is an explanatory diagram illustrating a method of calculating an enhancement coefficient.

The enhancement coefficient α is explained. FIG. 2 is an explanatory diagram illustrating a method of calculating the enhancement coefficient. As shown in FIG. 2, a difference between attainment gradation and initial gradation is plotted along an axis of abscissas, and a difference between enhanced gradation and initial gradation is plotted along an axis of ordinates. A value of a slope of a straight line 201 obtained by approximation using a least squared error method or the like corresponds to the enhancement coefficient α.

That is to say, when certain initial gradation is changed into certain attainment gradation in the liquid crystal display 200, enhanced gradation which is necessary for a change into the attainment gradation after one frame period (in general, after 16.7 ms) (gradation to be actually written into the liquid crystal display 200) is measured, so that the enhancement coefficient α can be calculated based on their relation.

The initial gradation is gradation of a displayed frame (previous frame), and serves as a standard gradation of the attainment gradation, i.e., gradation of a frame to be displayed next. Further, the enhancement coefficient α can be calculated simply according to the following formula (2):

$$\alpha = \left(1 - \exp\left(\frac{-\ln 10}{\tau}\Delta t\right)\right)^{-1} \tag{2}$$

where τ designates 0 to 90% response time of the liquid crystal display 200, and Δt designates one frame period (in general, 16.7 ms). The calculation in the formula (2) can be obtained according to the following formula (3) which is an approximation formula of transmittance of the liquid crystal display 200 and time:

$$T(t) = (T_1 - T_0)\left(1 - \exp\left(\frac{-\ln 10}{\tau}t\right)\right) + T_0 \tag{3}$$

where T(t) designates transmittance of a liquid crystal panel at time t (corresponding to brightness of the liquid crystal display 200), and designates time response in the case where the transmittance of the liquid crystal panel is changed from $T_0$ into $T_1$.

When a relation of enhanced gradation $L_E$ (corresponds to $T_1$ as transmittance) which is required when the gradation $L_0$ (corresponds to $T_0$ as transmittance) of the liquid crystal display 200 attains desired gradation $L_1$ (corresponds to T(1/60) as transmittance) after one frame period Δt (in general, 16.7 ms) is applied to the formula (3), the following formula (4) is obtained.

$$T\left(\frac{1}{60}\right) = L_1 = (L_E - L_0)\left(1 - \exp\left(\frac{-\ln 10}{\tau}\frac{1}{60}\right)\right) + L_0 \tag{4}$$

When the formula (4) is solved for the enhanced gradation $L_E$, the relation in the formula (1) is obtained, and the enhancement coefficient α corresponds to the formula (2). When the enhancement coefficient α is replaced by α'=α−1, the formula (1) can be rewritten like the following formula (5). Hence, the enhanced gradation calculating unit 120 may be structured so as to calculate the enhanced gradation using the formula (5).

$$L_E(N) = \alpha'(L_I(N) - L_R(N-1)) + L_1(N) \tag{5}$$

The enhanced gradation correcting unit 121 may be structured so as to determine whether enhancement is applied or not according to the threshold value process at this time. That is to say, the enhanced gradation correcting unit 121 corrects the enhanced gradation determined by the formula (1) or (5) according to the following formula (6):

$$L_E(N) = \begin{cases} L_I(N) & |L_I(N) - L_R(N-1)| < L_{th} \\ L_E(N) & \text{otherwise} \end{cases} \tag{6}$$

where $L_{th}$ designates a threshold value for determining whether enhancement is applied, and when the absolute value of the difference between the input gradation of the frame N and the predicted attainment gradation of the frame N−1 is less than the threshold value, the input gradation of the frame N is directly output. As a result, enhancement of noises can be prevented in the case where an input image includes a lot of noises, and an error of the enhanced gradation due to a predicted error of the predicted attainment gradation can be reduced.

When a color space of the input image includes three primary colors RGB, the formula (1) is expressed like the following formula (7):

$$\begin{bmatrix} R_E(N) \\ G_E(N) \\ B_E(N) \end{bmatrix} = \alpha \begin{bmatrix} R_I(N) - R_R(N-1) \\ G_I(N) - G_R(N-1) \\ B_I(N) - B_R(N-1) \end{bmatrix} + \begin{bmatrix} R_R(N-1) \\ G_R(N-1) \\ B_R(N-1) \end{bmatrix} \tag{7}$$

where R, G and B designate gradations of the three primary colors of image data, and subscripts are the same as those in the formula (1). Similarly, the formula (5) is expressed like the following formula (8).

$$\begin{bmatrix} R_E(N) \\ G_E(N) \\ B_E(N) \end{bmatrix} = \alpha' \begin{bmatrix} R_I(N) - R_R(N-1) \\ G_I(N) - G_R(N-1) \\ B_I(N) - B_R(N-1) \end{bmatrix} + \begin{bmatrix} R_I(N) \\ G_I(N) \\ B_I(N) \end{bmatrix} \tag{8}$$

At this time, the enhanced gradation correcting unit 121 may apply the threshold value process expressed by the formula (6) to the gradations of RGB, but a brightness component Y is calculated from the gradations of the RGB and the threshold value process is performed on Y, so that a determination may be made whether enhancement is applied to the gradations of RGB. That is to say, the enhanced gradation correcting unit 121 executes the threshold value process like the following formula (9).

$$[R_E(N)G_E(N)B_E(N)]^T = \begin{cases} [R_I(N)G_I(N)B_I(N)]^T & |Y_I(N) - Y_R(N-1)| < Y_{th} \\ [R_E(N)G_E(N)B_E(N)]^T & \text{otherwise} \end{cases} \tag{9}$$

where $Y_{th}$ designates the threshold value for determining whether enhancement is applied, and when an absolute value of a difference between $Y_I$ calculated from $R_I$, $G_I$, and $B_I$, and $Y_R$ calculated from $R_R$, $G_R$, and $B_R$ is less than $Y_{th}$, $R_I$, $G_I$, and B, of the input image data are output as they are.

Some coefficients are present for converting R, G, and B into Y, but in the first embodiment, a coefficient expressed by the following formula (10) is used. The coefficients are not limited to this, and thus all coefficients which are generally used for converting the RGB color space into a YUV color space can be used.

$$Y=0.299\times R+0.587\times G+0.114\times B \tag{10}$$

In the formula (7), the color space includes the three primary colors RGB, but when linear transformation is carried out on the formula (7), the color space can cope with the YUV color space composed of brightness and color difference components. That is to say, the interconversion between the RGB color space and the YUV color space is the linear transformation, and when a transformation matrix is designated by M, the relation of the formula (7) is expressed like the following formula (11):

$$\begin{aligned}\begin{bmatrix} R_E(N)-R_R(N-1) \\ G_E(N)-G_R(N-1) \\ B_E(N)-G_R(N-1) \end{bmatrix} &= M\begin{bmatrix} Y_E(N)-Y_R(N-1) \\ U_E(N)-U_R(N-1) \\ V_E(N)-V_R(N-1) \end{bmatrix} \\ &= \alpha M\begin{bmatrix} Y_I(N)-Y_R(N-1) \\ U_I(N)-U_R(N-1) \\ V_I(N)-V_R(N-1) \end{bmatrix} \\ &= \alpha\begin{bmatrix} R_I(N)-R_R(N-1) \\ G_I(N)-G_R(N-1) \\ B_I(N)-B_R(N-1) \end{bmatrix}\end{aligned} \tag{11}$$

where Y, U, and V designate gradations of the input image data in the YUV color space. The transformation matrix M may take various coefficients, but in the first embodiment, the coefficients in the following formula (12) are used. The transformation matrix is not limited to them, and thus all transformation matrices which are generally used for converting from the RGB color space into the YUV color space can be used.

$$M=\begin{bmatrix} 1.000 & 0.000 & 1.402 \\ 1.000 & -0.344 & -0.714 \\ 1.000 & 1.772 & 0.000 \end{bmatrix} \tag{12}$$

Since an inner product of M and $M^{-1}$ as to two center terms in the formula (11) is 1, a relation is established like the following formula (13):

$$\begin{bmatrix} Y_E(N) \\ U_E(N) \\ V_E(N) \end{bmatrix} = \alpha\begin{bmatrix} Y_I(N)-Y_R(N-1) \\ U_I(N)-U_R(N-1) \\ V_I(N)-V_R(N-1) \end{bmatrix} + \begin{bmatrix} Y_R(N-1) \\ U_R(N-1) \\ V_R(N-1) \end{bmatrix} \tag{13}$$

Similarly in the formula (8), a relation is established like the following formula (14):

$$\begin{bmatrix} Y_E(N) \\ U_E(N) \\ V_E(N) \end{bmatrix} = \alpha'\begin{bmatrix} Y_I(N)-Y_R(N-1) \\ U_I(N)-U_R(N-1) \\ V_I(N)-V_R(N-1) \end{bmatrix} + \begin{bmatrix} Y_I(N) \\ U_I(N) \\ V_I(N) \end{bmatrix} \tag{14}$$

Further, an YCbCr color space as brightness and color difference components can be transformed similarly to the YUV color space. Further, the similar formula transformation can be applied to the other color spaces on which the linear transformation from the RGB color space can be made.

In the first embodiment, gradation which is enhanced directly in the YUV color space can be calculated from a color space such as YUV color space, which is widely used for images to be saved and reproduced on PC and compressed images of digital broadcasting (MPEG-2, MPEG-4, H.264 and the like) and composed of brightness and color difference components, without transforming it into the RGB color space.

In the YUV color space, the formula (13) may be simplified like the following formula (15).

$$\begin{bmatrix} Y_E(N) \\ U_E(N) \\ V_E(N) \end{bmatrix} = \alpha\begin{bmatrix} Y_I(N)-Y_R(N-1) \\ 0 \\ 0 \end{bmatrix} + \begin{bmatrix} Y_R(N-1) \\ U_I(N) \\ V_I(N) \end{bmatrix} \tag{15}$$

The formula (15) means that only Y as the brightness component of the input image is enhanced but U and V as the color difference components are not enhanced and the gradation of the input image data is output as it is. Since spatial frequency sensitivity of the brightness component is generally higher than spatial frequency sensitivity of the color difference component, even when only the brightness component is enhanced for the improvement of response characteristics of the liquid crystal display 200, response characteristics are improved visually.

When the formula (15) is employed, since predicted attainment image data of the frame N−1 to be stored in the frame memory 140 is only Y, memory requirements can be reduced further than the case where the entire YUV color space is stored. Further, a calculated amount and a number of access times to the memory can be reduced, and thus throughput (processing time) can be reduced. Similarly, the formula (14) can be expressed like the following formula (16).

$$\begin{bmatrix} Y_E(N) \\ U_E(N) \\ V_E(N) \end{bmatrix} = \alpha'\begin{bmatrix} Y_I(N)-Y_R(N-1) \\ 0 \\ 0 \end{bmatrix} + \begin{bmatrix} Y_I(N) \\ U_I(N) \\ V_I(N) \end{bmatrix} \tag{16}$$

As to the application or non-application of the enhancement due to the threshold value-process in the YUV color space, the gradations of YUV may be subjected to the threshold value process like the formula (6); or similarly to the formula (9), they may be processed by the threshold value process on the Y value according to the following formula (17):

$$[Y_E(N)U_EV_E(N)]^T = \begin{cases} [Y_I(N)U_I(N)V_I(N)]^T & |Y_I(N)-Y_R(N-1)| < Y_{th} \\ [Y_E(N)U_E(N)V_E(N)]^T & \text{otherwise} \end{cases} \tag{17}$$

The enhanced image data calculated by the enhanced gradation calculating unit 120 have a limitation on the range of the gradation in all color spaces. In general, since image data is expressed by 8 bits, the range of the gradation of the data is 0 to 255. When the above-mentioned enhanced gradation calculation is performed, however, the enhanced gradation occasionally becomes less than 0 or exceeds 255 depending on the values of the gradation and the enhancement coefficients. In this case, as expressed by the following formula (18), the enhanced gradation correcting unit 121 should execute a saturation process on the enhanced gradation.

$$L'_E(N) = \text{round}(L_E(N)) \tag{18}$$

$$\text{round}(x) = \begin{cases} 0 & x < 0 \\ 255 & x > 255 \\ x & \text{otherwise} \end{cases}$$

The same holds for the RGB color space and the YUV color space. The enhanced gradation $L_E'$, which is subjected to the saturation process by the enhanced gradation correcting unit 121, is output as the enhanced image data of the frame N to the liquid crystal display 200.

The predicted attainment gradation calculating process by the predicted attainment gradation calculating unit 130 is explained in detail below. The predicted attainment gradation calculating unit 130 calculates predicted attainment gradation according to the following formula (19).

$$L_R(N)=\beta(L_E'(N)-L_R(N-1))+L_R(N-1) \tag{19}$$

where β designates a value which is called as a correction coefficient. It is desirable that the correction coefficient β and the enhancement coefficient α establish a relation expressed by the following formula (20):

$$\beta = \frac{1}{\alpha} \tag{20}$$

The formula (20) can be derived by the following relation. Firstly, the response characteristics of the liquid crystal display 200 can be expressed like the following formula (21) according to the formulas (1) and (4).

$$L_E-L_0=\alpha(L_1-L_0). \tag{21}$$

In the case where the enhanced gradation obtained by the formula (1) is written when the predicted attainment gradation of the frame N−1 is changed into the input gradation of the frame N, the formula (21) is rewritten into the following formula (22):

$$L_E(N)-L_R(N-1)=\alpha(L_I(N)-L_R(N-1)) \tag{22}$$

Actually, however, since the enhanced gradation is corrected into $L_E'$ according to the formula (18), it cannot attain the input gradation of the frame N, and when the actual attainment gradation of the frame N is regarded as predicted attainment gradation $L_R(N)$ of the frame N, the formula (22) is rewritten into the following formula (23):

$$L_E'(N)-L_R(N-1)=\alpha(L_R(N)-L_R(N-1)) \tag{23}$$

When the formula (23) is solved for $L_R(N)$, the following formula (24) is obtained:

$$L_R(N) = \frac{1}{\alpha}(L'_E(N) - L_R(N-1)) + L_R(N-1) \tag{24}$$

According to the formulas (24) and (19), the relation of the formula (20) is derived. The relation of the formula (20), however, does not have to be strictly established, and the correction coefficient may be a value close to an inverse number of the enhancement coefficient. Further, the predicted attainment gradation $L_R(N)$ of the frame N in the case where $\alpha'=\alpha-1$ may be calculated according to the following formula (25).

$$L_R(N) = \frac{1}{\alpha'+1}(L'_E(N) - L_R(N-1)) + L_R(N-1) \tag{25}$$

In this case, correction coefficient β and α' establish a relation expressed by the following formula (26'):

$$\beta = \frac{1}{\alpha'+1} \tag{26}$$

When the input image has primary three colors of the RGB color space, similarly to the enhanced gradation calculating process, the formula (19) is expressed like the following formula (27):

$$\begin{bmatrix} R_R(N) \\ G_R(N) \\ B_R(N) \end{bmatrix} = \beta \begin{bmatrix} R'_E(N) - R_R(N-1) \\ G'_E(N) - G_R(N-1) \\ B'_E(N) - B_R(N-1) \end{bmatrix} + \begin{bmatrix} R_R(N-1) \\ G_R(N-1) \\ B_R(N-1) \end{bmatrix} \tag{27}$$

Also when the input image is made up of the brightness and color difference components of the YUV color space, the formula (19) is similarly expressed like the following formula (28):

$$\begin{bmatrix} Y_R(N) \\ U_R(N) \\ V_R(N) \end{bmatrix} = \beta \begin{bmatrix} Y'_E(N) - Y_R(N-1) \\ U'_E(N) - U_R(N-1) \\ V'_E(N) - V_R(N-1) \end{bmatrix} + \begin{bmatrix} Y_R(N-1) \\ U_R(N-1) \\ V_R(N-1) \end{bmatrix} \tag{28}$$

It is desired that the correction coefficient satisfies the formula (20) or (26) in all the color spaces. When the enhanced gradation is calculated by using only the brightness component in the YUV color space like the formula (15), the predicted attainment gradation calculating unit 130 can be similarly structured so as to process only the brightness component like the following formula (29):

$$\begin{bmatrix} Y_R(N) \\ U_R(N) \\ V_R(N) \end{bmatrix} = \beta \begin{bmatrix} Y'_E(N) - Y_R(N-1) \\ 0 \\ 0 \end{bmatrix} + \begin{bmatrix} Y_R(N-1) \\ U_I(N) \\ V_I(N) \end{bmatrix} \tag{29}$$

The predicted attainment image data of the frame N is calculated by using the enhanced image data of the frame N and the predicted attainment image data of the frame N−1, and the calculated predicted attainment image data is input into the frame memory 140 and data in the frame memory 140 are updated in order to refer to them at the next process.

Figure 3:
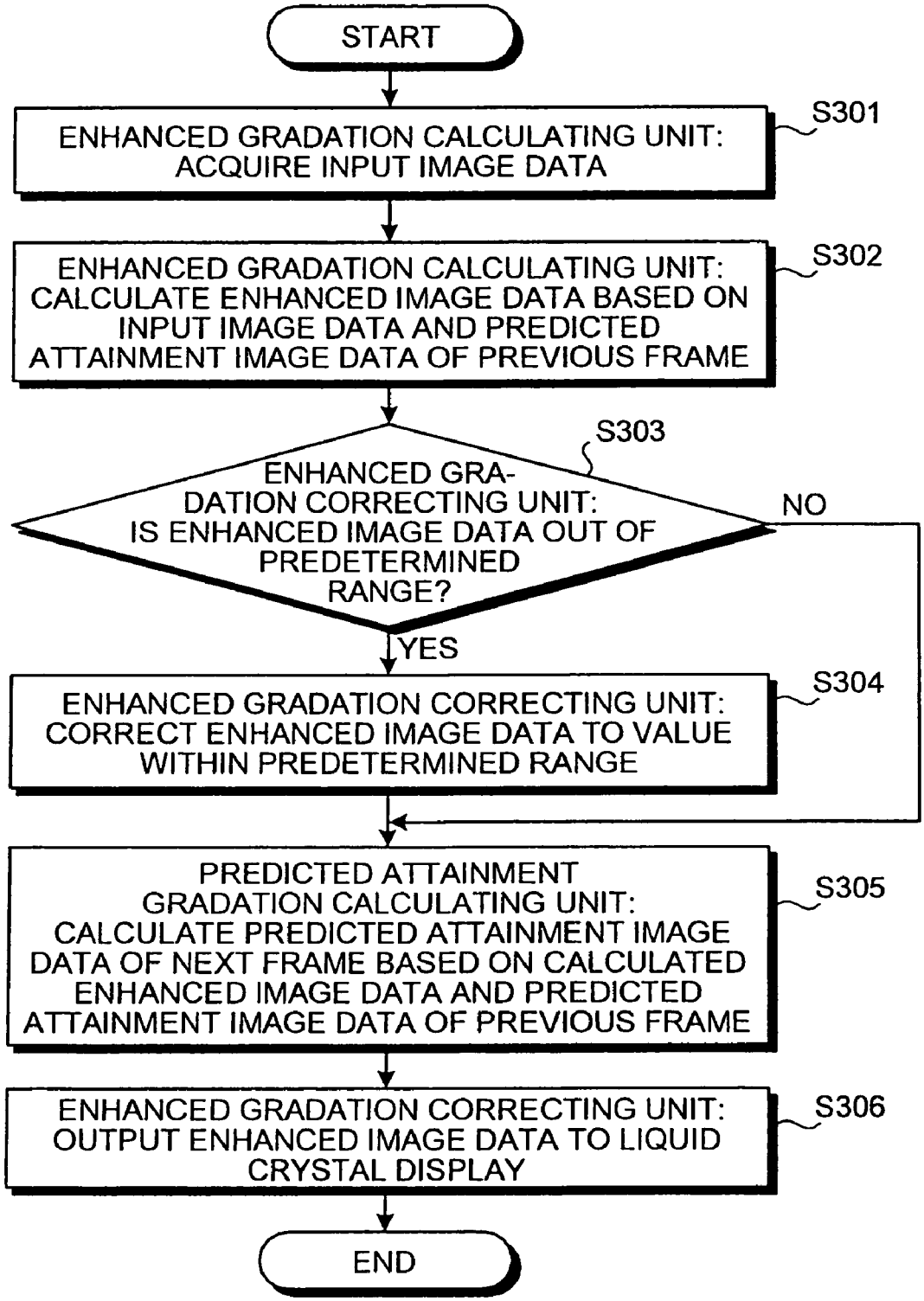
FIG. 3 is a flowchart illustrating an entire flow of an image process according to the first embodiment.

An image process by the image processing apparatus 100 according to the first embodiment having such a structure is explained below. FIG. 3 is a flowchart illustrating an entire flow of the image process in the first embodiment.

The enhanced gradation calculating unit 120 acquires input image data (step S301). The enhanced gradation calculating unit 120 calculates enhanced image data based on input image data and predicted attainment image data in a previous frame (step S302).

Specifically, the input image data is substituted into $L_I(N)$ in the formula (1), the predicted attainment image data in the previous frame is substituted into $L_R(N-1)$, and $L_E(N)$ is calculated as enhanced image data.

The enhanced gradation correcting unit 121 determines whether the enhanced image data is out of a predetermined range or not (step S303). When the enhanced image data is out of the range (YES at step S303), the enhanced gradation correcting unit 121 corrects the enhanced image data to a value within the predetermined range (step S304).

More specifically, when the calculated enhanced image data has a value smaller than a minimum value (for example, 0) in the predetermined range, the enhanced gradation correcting unit 121 corrects the enhanced image data to 0 as expressed by the formula (18). When the calculated enhanced image data has a value larger than a maximum value (for example, 255) in the predetermined range, the enhanced gradation correcting unit 121 corrects the enhanced image data to 255.

The predicted attainment gradation calculating unit 130 calculates predicted attainment image data of a next frame based on the calculated enhanced image data and the predicted attainment image data of the previous frame (step S305).

Specifically, the predicted attainment gradation calculating unit 130 substitutes the enhanced image data corrected by the enhanced gradation correcting unit 121 into $L_E(N)$ in the formula (19) and substitutes the predicted attainment image data in the previous frame into $L_R(N-1)$ so as to calculate $L_R(N)$ as the predicted attainment image data.

The enhanced gradation correcting unit 121 outputs the corrected enhanced image data to the liquid crystal display 200 (step S306), and ends the image process. Since the process for calculating the predicted attainment image data and the process for outputting the data to the liquid crystal display 200 are independent from each other, step S305 and step S306 may be interchanged or they may be executed simultaneously.

A specific example of the image process in the image processing apparatus 100 according to the first embodiment is explained below. The case where 0 gradation is displayed until frame 0, 255 gradation is displayed in frame 1, and 80 gradation is displayed in frame 2 and thereafter on the liquid crystal display 200 whose enhancement coefficient $\alpha$ is 1.42 is considered. In a change from frame 0 to frame 1, since the predicted attainment gradation of the frame 0 (frame N−1) is 0 and the input gradation of the frame 1 (frame N) is 255, the enhanced gradation calculating unit 120 calculates enhanced gradation by using the formula (1) according to calculation in the following formula (30):

$$L_E(1)=1.42(255-0)+0=362 \tag{30}$$

Since, however, the image data takes only 8 bits, namely, has only 255 gradations, the enhanced gradation correcting unit 121 corrects the enhanced gradation according to the formula (18), and after the enhanced gradation is saturated to 255 gradations, the resulting image data is displayed on the liquid crystal display 200. The predicted attainment gradation calculating unit 130 calculates predicted attainment gradation of the frame 1 (frame N) by using the enhanced gradation 255 of the frame 1 (frame N) and the predicted attainment gradation 0 of the frame 0 (frame N−1) according to the formula (19) like the following formula (31):

$$L_R(1) = \frac{1}{1.42}(255-0)+0 = 180 \tag{31}$$

The relation in the formula (20) is used as the correction coefficient here. The result of the formula (31) shows that the input gradation 255 of the frame 1 is different from the predicted attainment gradation 180 of the frame 1, namely, the response of the liquid crystal display 200 is not completed in a one frame period of frame 1.

Since the predicted attainment gradation of frame 1 (frame N−1) is 180 gradation and input gradation of frame 2 (frame N) is 80 gradation at a next frame, the enhanced gradation calculating unit 120 calculates the enhanced gradation by using the formula (1) according to calculation in the following formula (32):

$$L_E(2)=1.42(80-180)+180=38 \tag{32}$$

The calculated enhanced gradation is displayed on the liquid crystal display 200. The predicted attainment gradation calculating unit 130 calculates predicted attainment gradation of frame 2 (frame N) by using the enhanced gradation 38 of the frame 2 (frame N) and the predicted attainment gradation 180 of the frame 1 (frame N−1) by the formula (19) like the following formula (33):

$$L_R(2) = \frac{1}{1.42}(38-180)+180 = 80 \tag{33}$$

The result of the formula (33) shows that the input gradation of the frame 2 is equal to the predicted attainment gradation of the frame 2, namely, the response of the liquid crystal display 200 is completed in one frame period for frame 1.

On the other hand, like a conventional technique, if the enhanced gradation of the frame 2 is calculated with the use of the input gradation 255 of the frame 1 based on the assumption that the response of the liquid crystal display 200 is completed without the use of the predicted attainment gradation 180 of the frame 1, the calculation is performed like the following formula (34):

$$L_E(2)=1.42(80-255)+255=7 \tag{34}$$

Figure 4:
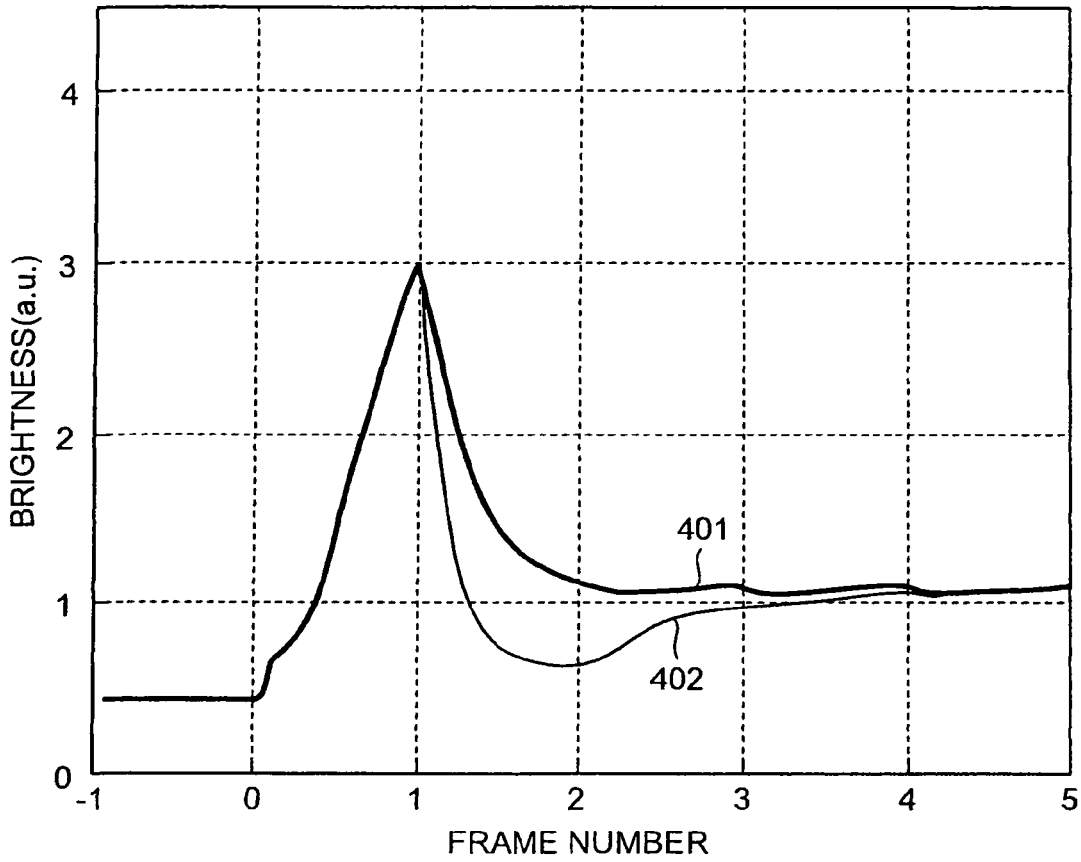
FIG. 4 is an explanatory diagram illustrating one example of a response waveform of a liquid crystal display.

FIG. 4 is an explanatory diagram illustrating one example of a response waveform of the liquid crystal display 200. In FIG. 4, a waveform 401 shows a response waveform observed when the predicted attainment gradation is used, and a waveform 402 shows a response waveform observed when the predicted attainment gradation is not used.

When the predicted attainment gradation is not used as in the conventional technique, even though the liquid crystal display 200 does not attain gradation 255 for frame 1, the liquid crystal display 200 is assumed to have attained gradation 255 and gradation 7 which is the enhanced gradation of the frame 2 is obtained and displayed on the liquid crystal display 200. For this reason, the gradation is excessively enhanced, and thus undershoot is generated on the response waveform as shown in the waveform 402 in FIG. 4.

On the other hand, when the predicted attainment gradation is used as in the first embodiment, 38 gradation, which is the enhanced gradation of the frame 2, is obtained by using 180 gradation which is the actual attainment gradation of the frame 1 so as to be displayed on the liquid crystal display device 200. For this reason, 80 gradation is attained in one frame period for frame 1 as shown in the waveform 401 in FIG. 4.

The image processing apparatus 100 according to the first embodiment can calculate predicted attainment gradation of a previous frame, and calculate enhanced gradation based on the calculated predicted attainment gradation and the input gradation to output the calculated enhanced gradation to the liquid crystal display device. For this reason, the comparatively simple operations can provide to the users clear images, in which blur of a moving image due to a slow response speed of the liquid crystal display device and deterioration of an image quality due to distortion of a response waveform do not occur.

The image processing apparatus according to a second embodiment uses the value of input gradation as predicted attainment gradation when the absolute value of a difference between the predicted attainment gradation and the input gradation is smaller than a predetermined value.

Figure 5:
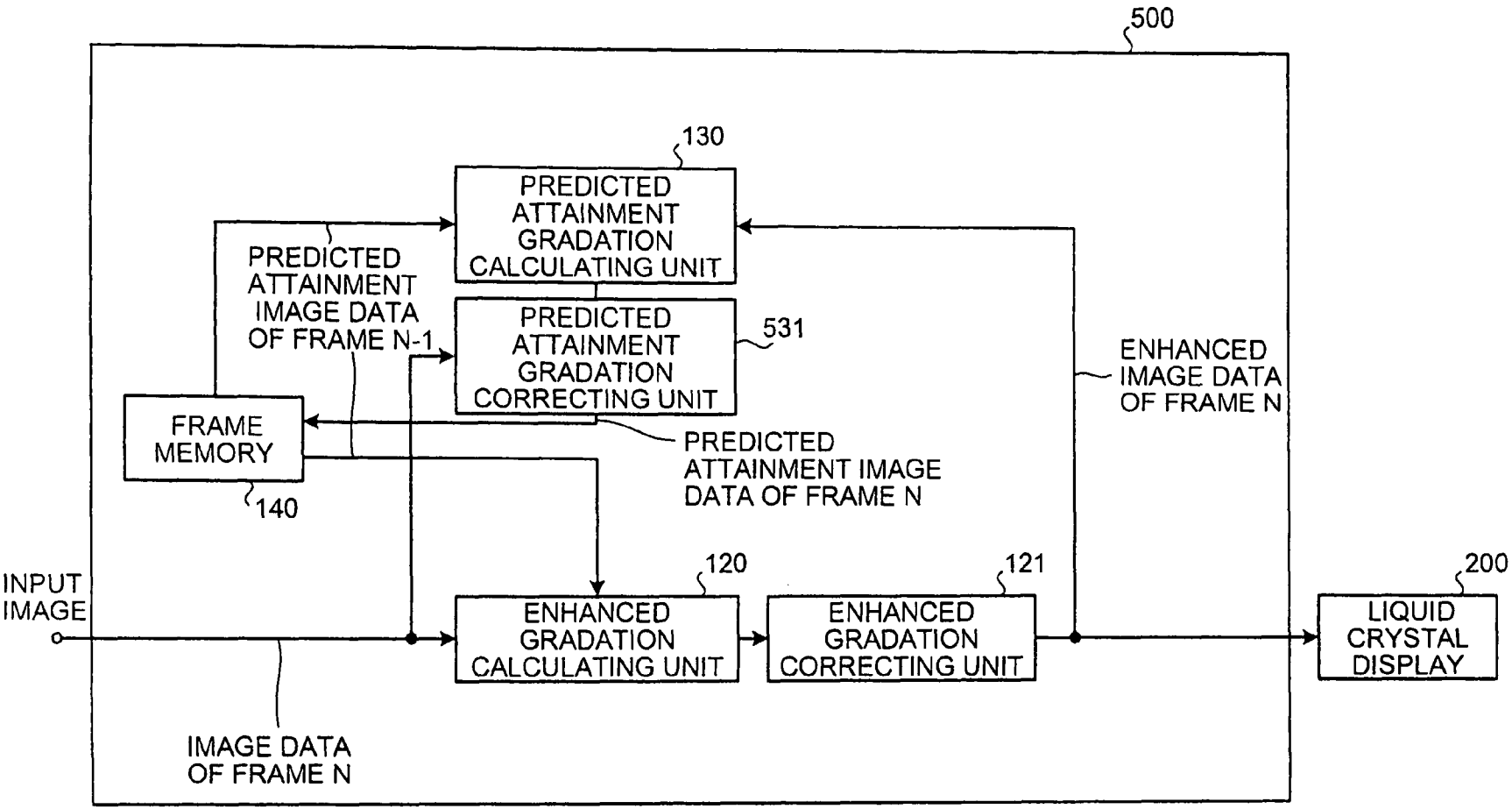
FIG. 5 is a block diagram illustrating a structure of the image processing apparatus according to a second embodiment.

FIG. 5 is a block diagram illustrating a structure of the image processing apparatus 500 according to the second embodiment. As shown in FIG. 5, the image processing apparatus 500 has the enhanced gradation calculating unit 120; the enhanced gradation correcting unit 121, the predicted attainment gradation calculating unit 130, a predicted attainment gradation correcting unit 531, and the frame memory 140.

The second embodiment is different from the first embodiment in that the predicted attainment gradation correcting unit 531 is added. Since the other parts of the structure and the function are similar to those of the image processing apparatus 100 according to the first embodiment shown in FIG. 1 which is the block diagram illustrating the structure of the image processing apparatus 100 according to the first embodiment, they are designated by like numbers, and the explanation thereof is not repeated.

When an absolute value of a difference between a value of predicted attainment image data calculated by the predicted attainment gradation calculating unit 130 and a value of input image data is smaller than a predetermined threshold value, the predicted attainment gradation correcting unit 531 corrects the value of the predicted attainment image data to the value of the input image data.

More specifically, the predicted attainment gradation correcting unit 531 corrects the predicted attainment gradation to the input gradation according to the threshold value process expressed by the following formula (35):

$$L_R(N) = \begin{cases} L_I(N) & |L_I(N) - L_R(N-1)| < L_{th2} \\ L_R(N) & \text{otherwise} \end{cases} \tag{35}$$

where $L_{th2}$ designates a threshold value for determining whether the predicted attainment gradation is corrected to the input gradation or not. That is to say, when the absolute value of the difference between input gradation of the frame N and predicted attainment gradation of the frame N−1 is less than the predetermined threshold value $L_{th2}$, the predicted attainment gradation of the frame N is corrected to the input gradation of the frame N. As a result, when the difference between the input gradation of the frame N and the predicted attainment gradation of the frame N−1 becomes small enough, the predicted attainment gradation is corrected to the input gradation, so that an error of the predicted attainment gradation is reset and the error can be prevented from propagating between frames.

Further, in the case of the RGB color space, the predicted attainment gradation correcting unit 531 may execute the threshold value process expressed by the formula (35) on the respective gradations of RGB, or may obtain Y based on the gradations of RGB so as to execute the threshold value process like the following formula (36):

$$[R_R(N)G_R(N)B_R(N)]^T = \begin{cases} [R_I(N)G_I(N)B_I(N)]^T & |Y_I(N) - Y_R(N-1)| < Y_{th2} \\ [R_R(N)G_R(N)B_R(N)]^T & \text{otherwise} \end{cases} \tag{36}$$

where $Y_{th2}$ designates a threshold value for determining whether the predicted attainment gradation is corrected to the input gradation or not.

In the case of the YUV color space, the predicted attainment gradation correcting unit 531 may execute the threshold value process on Y, U, and V, or may compare only Y values as expressed by the following formula (37), so as to execute the threshold value process.

$$[Y_R(N)U_R(N)V_R(N)]^T = \begin{cases} [Y_I(N)U_I(N)V_I(N)]^T & |Y_I(N) - Y_R(N-1)| < Y_{th2} \\ [Y_R(N)U_R(N)V_R(N)]^T & \text{otherwise} \end{cases} \tag{37}$$

Figure 6:
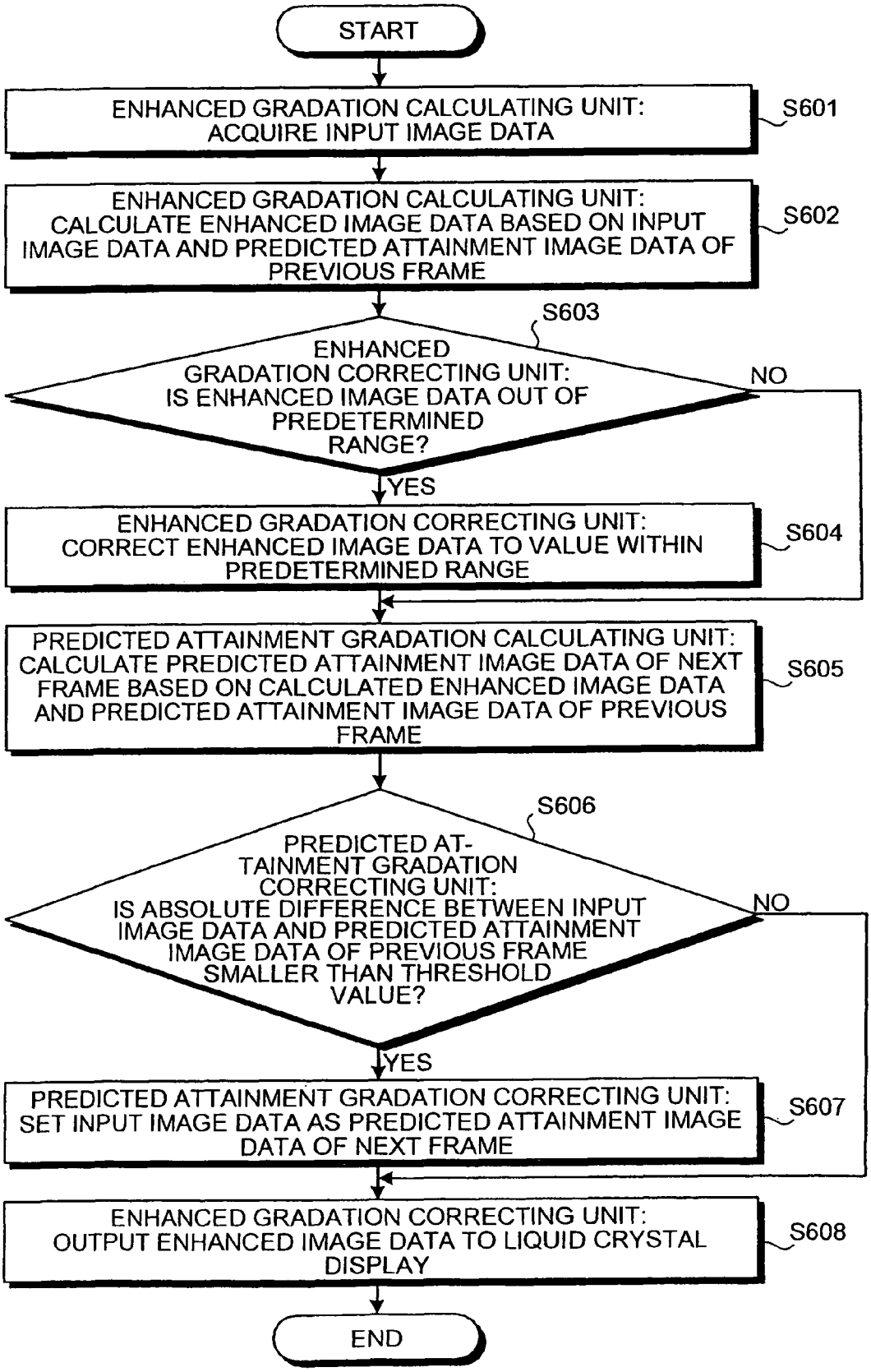
FIG. 6 is a flowchart illustrating an entire flow of the image process according to the second embodiment.

The image process by the image processing apparatus 500 according to the second embodiment having such a structure is explained below. FIG. 6 is a flowchart illustrating an entire flow of the image process according to the second embodiment.

Since the enhanced gradation calculating and correcting process at steps S601 to S605 is the same as that at steps S301 to S305 in the image processing apparatus 100 according to the first embodiment, the explanation thereof is not repeated.

After the predicted attainment gradation calculating unit 130 calculates predicted attainment image data at step S605, the predicted attainment gradation correcting unit 531 determines whether the absolute difference between input image data and predicted attainment image data of a previous frame is smaller than a predetermined threshold value or not (step S606).

When the determination is made that the absolute difference is smaller than the threshold value (YES at step S606), the predicted attainment gradation correcting unit 531 sets the input image data as predicted attainment image data of a next frame (step S607). More specifically, as expressed by the formula (35), the absolute difference between $L_I(N)$ and $L_R(N-1)$ is calculated, and when the calculated value is smaller than the predetermined threshold value $L_{th2}$, $L_I(N)$ is substituted into the predicted attainment image data $L_R(N)$.

After the predicted attainment image data is corrected or the determination is made that the absolute difference is not less than the predetermined threshold value (NO at step S606), the enhanced gradation correcting unit 121 outputs the corrected enhanced image data to the liquid crystal display 200 (step S608), and the image process is ended.

When the absolute difference between the predicted attainment gradation and the input gradation is smaller than the predetermined value, the image processing apparatus 500 according to the second embodiment uses the value of the input gradation as the predicted attainment gradation. As a result, an error at the time of calculating the predicted attainment gradation is eliminated, and the error can be prevented from propagating between frames.

The image processing apparatus according to a third embodiment decodes an input compressed moving-image, calculates predicted attainment gradation and enhanced gradation for the decoded image data, and converts a color space of the enhanced gradation into a format with which it can be displayed by the liquid crystal display device so as to output the gradation. That is to say, the third embodiment refers to one example of the structure in which the present invention is applied to an ordinary PC, and a compressed moving image treated generally on the PC is processed so as to be output to the liquid crystal display device.

Figure 7:
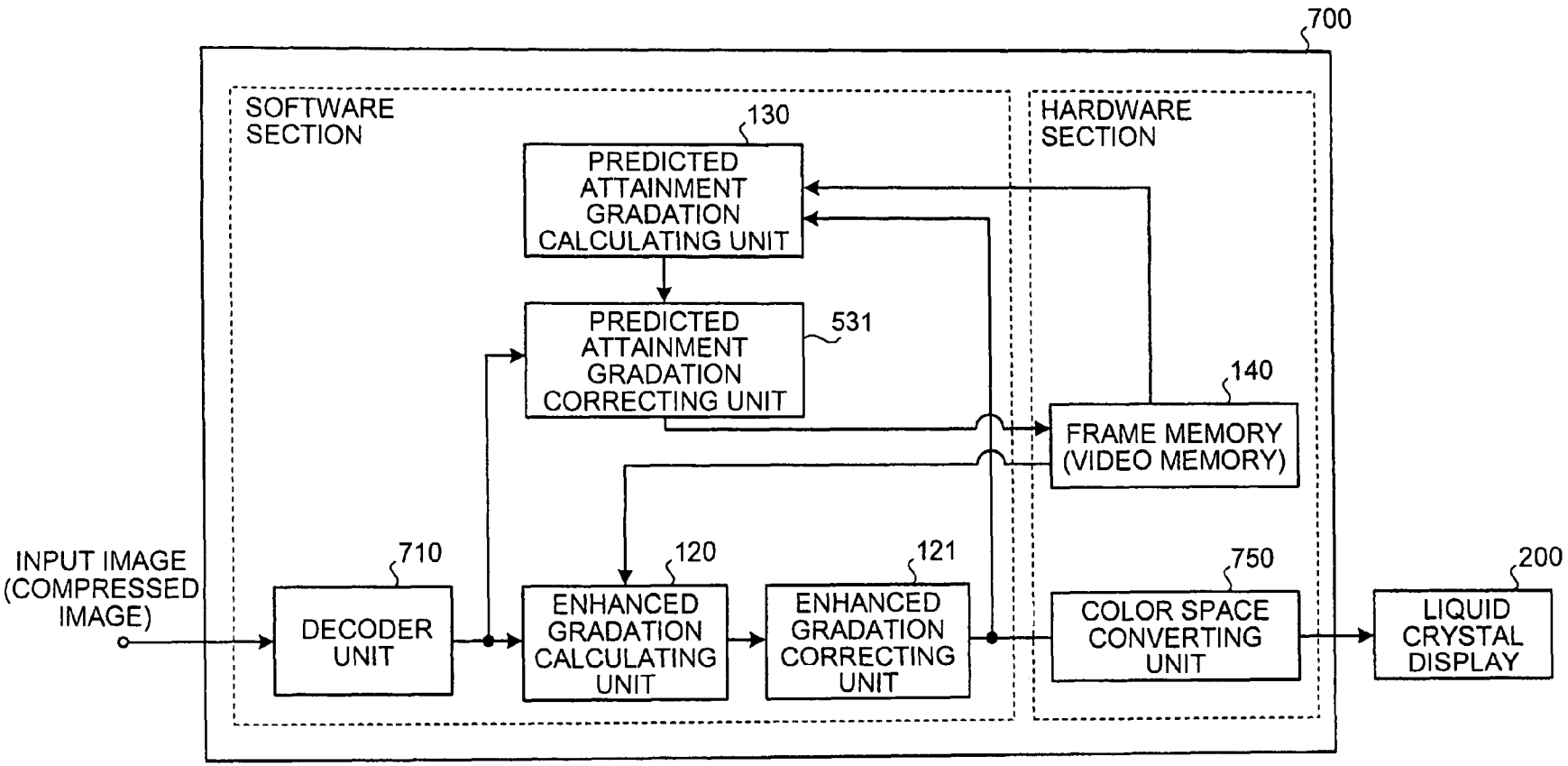
FIG. 7 is a block diagram illustrating a structure of the image processing apparatus according to a third embodiment.

FIG. 7 is a block diagram illustrating a structure of the image processing apparatus 700 according to the third embodiment. As shown in FIG. 7; the image processing apparatus 700 has the enhanced gradation calculating unit 120, the enhanced gradation correcting unit 121, the predicted attainment gradation calculating unit 130, the predicted attainment gradation correcting unit 531, the frame memory 140, a decoder unit 710 and a color space converting unit 750.

The third embodiment is different from the second embodiment in that the decoder unit 710 and the color space converting unit 750 are added. Since the other parts of the structure and function are similar to those of the image processing apparatus 500 according to the second embodiment shown in FIG. 5 which is the block diagram illustrating the structure of the image processing apparatus 500 according to the second embodiment, they are designated by like numbers and the explanation thereof is not repeated.

As shown in FIG. 7, the third embodiment is made up of a software section including the decoder unit 710, the enhanced gradation calculating unit 120, the enhanced gradation correcting unit 121, the predicted attainment gradation calculating unit 130, and the predicted attainment gradation correcting unit 531, and a hardware section including the frame memory 140 and the color-space converting unit 750.

The decoder unit 710 is a software decoder that decodes input compressed image data (compressed moving image), and outputs the decoded input image data to the enhanced gradation calculating unit 120.

A moving image which is generally treated on PC includes compressed moving images such as MPEG-72, MPEG-4, and H.264. These compressed moving images are decoded by the decoder unit 710. Since these compressed moving images generally have a YUV format composed of brightness and color difference, a decoded result obtained by the decoder unit 710 is image data having the YUV format.

In the third embodiment, the compressed image is input. For example, image data which is received by a TV tuner or the like on the PC may be input, or image data which is captured by a capture board may be input. Here, the decoder unit 710 serves as a tuner unit that takes out image data from a composite image signal or as a capture-unit that captures input image data. In both the cases, input image data treated on the PC generally has the YUV format. The input image data which is decoded by the decoder unit 710 is, therefore; output to the enhanced gradation calculating unit 120 in the YUV format.

The enhanced gradation calculating unit 120 calculates enhanced gradation enhanced directly in the YUV color space without converting the input image data having the YUV format into a RGB color space as explained in the first embodiment. The enhanced gradation, which is calculated by the enhanced gradation calculating unit 120 and corrected by the enhanced gradation correcting unit 121, is input into the predicted attainment gradation calculating unit 130 and the color space converting unit 750.

The operation of the predicted attainment gradation calculating unit 130 is similar to those in the first and the second embodiments, and the predicted attainment gradation calculated by the predicted attainment gradation calculating unit 130 is input into the frame memory 140. The frame memory 140 can use a video memory mounted onto a video card of the PC.

The color space converting unit 750 converts image data having the YUV format into image data having the RGB format. The color space converting unit 750 is generally incorporated into a Graphics Processing Unit (GPU) on a video card of the PC, and converts a color space at a high speed by means of hardware. Since the liquid crystal display 200 is designed so as to display image data having the RGB format, image data having the YUV format which is treated by PC is converted into image data having the RGB format by the color space converting unit 750 so as to be output to the liquid crystal display 200. The liquid crystal display 200 displays enhanced image data having the RGB format.

The enhanced image data is synthesized in an image reproducing window which is a display area on a screen allocated by a window system running on the PC, and image data on the entire screen after synthesis is converted into image data having the RGB format by the color-space converting unit 750 in the GPU so as to be displayed on the liquid crystal display 200. That is to say, the enhanced gradation calculating process can be selectively executed only on the image reproducing window.

In the above structure, the parts generally not included in the structure of the PC are only the enhanced gradation calculating unit 120 and the predicted attainment gradation calculating unit 130, and since these performs only very simple operations as explained in the first embodiment, they are operated at an sufficiently high speed (in real time) by the software. That is to say, the image quality of a moving image to be reproduced on the PC can be improved without changing the hardware structure of the PC.

In the third embodiment, the decoder unit 710, the enhanced gradation calculating unit 120, the enhanced gradation correcting unit 121, the predicted attainment gradation calculating unit 130, and the predicted attainment gradation correcting unit 531 are made up of the software, but some or all of them may be made up of hardware.

In the image processing apparatus 700 according to the third embodiment, even in the structure using a normal PC, the blur of a moving image due to a slow response speed of the liquid crystal display device and the deterioration of the image quality due to distortion of a response waveform are decreased by the comparatively simple operations, so that the image quality of a moving image to be displayed on the liquid crystal display device can be improved.

The image processing apparatuses according to the first to the third embodiments can be a hardware structure which utilizes a normal computer having a control unit such as a Central Processing Unit (CPU), a storage device such as a Read only Memory (ROM) or a Random Access Memory (RAM), an external storage device such as a Hard Disc Drive (HDD) or a Compact Disc (CD) drive device, and an input device such as a keyboard or a mouse.

The image processing programs which are executed by the image processing apparatus according to the first to the third embodiments are provided in such a manner that the programs are recorded into recording media readable by the computer, such as a Compact Disc Read Only Memory (CD-ROM), a flexible disc (FD), a Compact Disc Recordable (CD-R), and a Digital Versatile Disk (DVD), which are files having an installable format or an executable format.

The image processing programs which are executed by the image processing apparatus according to the first to the third embodiments are stored on the computer connected to a network such as the internet, and may be downloaded via the network so as to be provided. Further, the image processing programs which are executed by the image processing apparatus according to the first to the third embodiments may be provided or distributed via a network such as the internet.

The image processing programs according to the first to the third embodiments may be incorporated into a ROM or the like in advance so as to be provided.

The image processing programs which are executed by the image processing apparatus according to the first to the third embodiments are structured into modules including the above-mentioned respective units (the enhanced gradation calculating unit, the enhanced gradation correcting unit, the predicted attainment gradation calculating unit, the predicted attainment gradation correcting unit, and the decoder unit). The CPU (processor) as actual hardware reads the image processing programs from the storage medium so as to execute them. As a result, the respective units are loaded onto a main storage device and are generated on the main storage device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image processing method for a liquid crystal display device, comprising:

calculating first difference gradation, which is a difference between predicted attainment gradation and input gradation, the predicted attainment gradation being a predicted value of gradation which respective pixels of the liquid crystal display attain after one frame period after the respective pixels are driven to display a first frame, and the predicted attainment gradation being stored in a storage unit which stores the predicted attainment gradation, and the input gradation being gradation of a second frame which is displayed after the first frame;

multiplying the first difference gradation by an enhancement coefficient;

calculating enhanced gradation which is a sum of the first difference gradation multiplied by the enhancement coefficient and the predicted attainment gradation;

calculating second difference gradation which is a difference between the enhanced gradation and the predicted attainment gradation;

multiplying the second difference gradation by a correction coefficient;

updating the value of the predicted attainment gradation stored in the storage unit based on a sum of the second difference gradation multiplied by the correction coefficient and the predicted attainment gradation; and correcting the enhanced gradation to a value within a predetermined range when the enhanced gradation has a value which is out of the predetermined range, wherein the multiplying the first difference gradation by the enhancement coefficient includes multiplying the first difference gradation by a coefficient obtained by subtracting one from the enhancement coefficient; and the calculating the enhanced gradation includes calculating a sum of the first difference gradation multiplied by the coefficient obtained by subtracting one from the enhancement coefficient and the input gradation as the enhanced gradation.

2. The image processing method for a liquid crystal display device according to claim 1, wherein:

the correcting the enhanced gradation includes correcting the enhanced gradation to the value of the input gradation when an absolute value of the first difference gradation is smaller than a predetermined threshold value.

3. An image processing method for a liquid crystal display device, comprising:

calculating first difference gradation, which is a difference between predicted attainment gradation and input gradation, the predicted attainment gradation being a predicted value of gradation which respective pixels of the liquid crystal display attain after one frame period after the respective pixels are driven to display a first frame, and the predicted attainment gradation being stored in a storage unit which stores the predicted attainment gradation, and the input gradation being gradation of a second frame which is displayed after the first frame;

multiplying the first difference gradation by an enhancement coefficient;

calculating enhanced gradation which is a sum of the first difference gradation multiplied by the enhancement coefficient and the predicted attainment gradation;

calculating second difference gradation which is a difference between the enhanced gradation and the predicted attainment gradation;

multiplying the second difference gradation by a correction coefficient;

updating the value of the predicted attainment gradation stored in the storage unit based on a sum of the second difference gradation multiplied by the correction coefficient and the predicted attainment gradation; and correcting the predicted attainment gradation to the value of the input gradation when an absolute value of the first difference gradation is smaller than a predetermined threshold value, wherein the multiplying the first difference gradation by the enhancement coefficient includes multiplying the first difference gradation by a coefficient obtained by subtracting one from the enhancement coefficient; and the calculating the enhanced gradation includes calculating a sum of the first difference gradation multiplied by the coefficient obtained by subtracting one from the enhancement coefficient and the input gradation as the enhanced gradation.

4. An image processing method for a liquid crystal display device, comprising:

calculating first difference gradation, which is a difference between predicted attainment gradation and input gradation, the predicted attainment gradation being a predicted value of gradation which respective pixels of the liquid crystal display attain after one frame period after the respective pixels are driven to display a first frame, and the predicted attainment gradation being stored in a storage unit which stores the predicted attainment gradation, and the input gradation being gradation of a second frame which is displayed after the first frame;

multiplying the first difference gradation by an enhancement coefficient;

calculating enhanced gradation which is a sum of the first difference gradation multiplied by the enhancement coefficient and the predicted attainment gradation;

calculating second difference gradation which is a difference between the enhanced gradation and the predicted attainment gradation;

multiplying the second difference gradation by a correction coefficient; and updating the value of the predicted attainment gradation stored in the storage unit based on a sum of the second difference gradation multiplied by the correction coefficient and the predicted attainment gradation, wherein the multiplying the first difference gradation by the enhancement coefficient includes multiplying the first difference gradation by a coefficient obtained by subtracting one from the enhancement coefficient;

the calculating the enhanced gradation includes calculating a sum of the first difference gradation multiplied by the coefficient obtained by subtracting one from the enhancement coefficient and the input gradation as the enhanced gradation; and each of the predicted attainment gradation, the input gradation, the first difference gradation, the enhanced gradation, and the second difference gradation includes a component of brightness information and a component of color difference information.

* * * * *